US008690483B2

(12) United States Patent
Leverette

(10) Patent No.: US 8,690,483 B2
(45) **Date of Patent: *Apr. 8, 2014**

(54) METHOD FOR ASSEMBLING TENDONS

(71) Applicant: Seahorse Equipment Corp, Houston, TX (US)

(72) Inventor: Steven John Leverette, Richmond, TX (US)

(73) Assignee: Seahorse Equipment Corp, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/057,733

(22) Filed: Oct. 18, 2013

(65) Prior Publication Data

US 2014/0044492 A1 Feb. 13, 2014

Related U.S. Application Data

(63) Continuation of application No. 13/095,597, filed on Apr. 27, 2011, now Pat. No. 8,585,326.

(60) Provisional application No. 61/328,297, filed on Apr. 27, 2010.

(51) Int. Cl.
*E02D 25/00* (2006.01)
*B63B 35/44* (2006.01)

(52) U.S. Cl.
USPC ..... 405/223.1; 405/158; 114/264

(58) Field of Classification Search
USPC ..... 405/158, 159, 169, 170, 203, 204, 405/223.1, 224; 114/264, 265
See application file for complete search history.

(56) References Cited

U.S. PATENT DOCUMENTS

| | | | |
|---|---|---|---|
| 4,169,424 | A | 10/1979 | Newby et al. |
| 4,585,373 | A | 4/1986 | Collipp |
| 4,784,529 | A | 11/1988 | Hunter |
| 4,810,133 | A | 3/1989 | Kopp et al. |
| 4,829,928 | A | 5/1989 | Bergman |
| 5,558,467 | A | 9/1996 | Horton |
| 5,707,178 | A | 1/1998 | Srinivasan |
| 6,004,071 | A | 12/1999 | Broeder et al. |
| 6,447,208 | B1 | 9/2002 | Huang et al. |
| 7,462,000 | B2 | 12/2008 | Leverette et al. |
| 7,621,698 | B2 | 11/2009 | Pallini, Jr. et al. |
| 7,854,570 | B2 | 12/2010 | Heidari |
| 2006/0201564 | A1 | 9/2006 | Pllack et al. |
| 2010/0104371 | A1 | 4/2010 | Scaini et al. |

*Primary Examiner* — David Bagnell
*Assistant Examiner* — Kyle Armstrong
(74) *Attorney, Agent, or Firm* — Wong, Cabello, Lutsch, Rutherford & Brucculeri, LLP.

(57) ABSTRACT

A tendon is assembled in a horizontal orientation using connectors or by welding at a weld station on a barge or other vessel located at or near the installation site of a tension leg platform. During assembly, the tendon is pulled away from the assembly vessel and tensioned by a tug or offshore work vessel. When fully assembled, the tendon may be up-ended in a manner similar to a wet-towed tendon, and then either pre-installed using floats or passed over to a TLP which is on-site and ready to receive tendons.

14 Claims, 1 Drawing Sheet

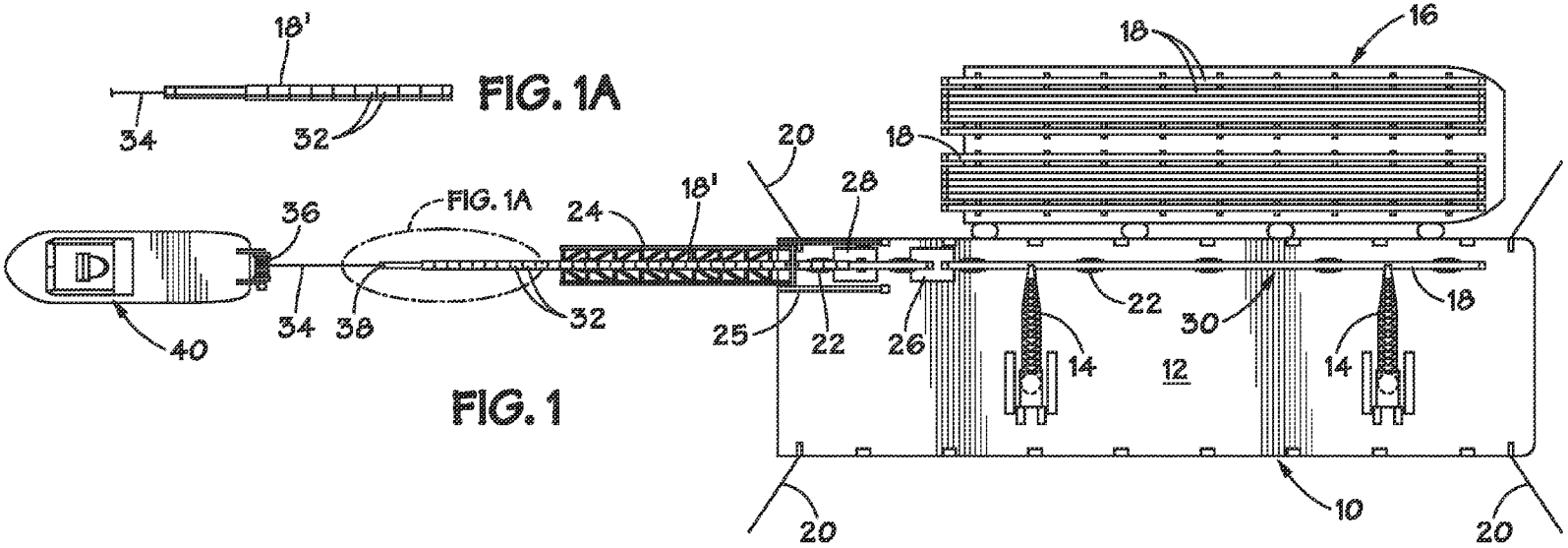
FIG. 1
FIG. 1A
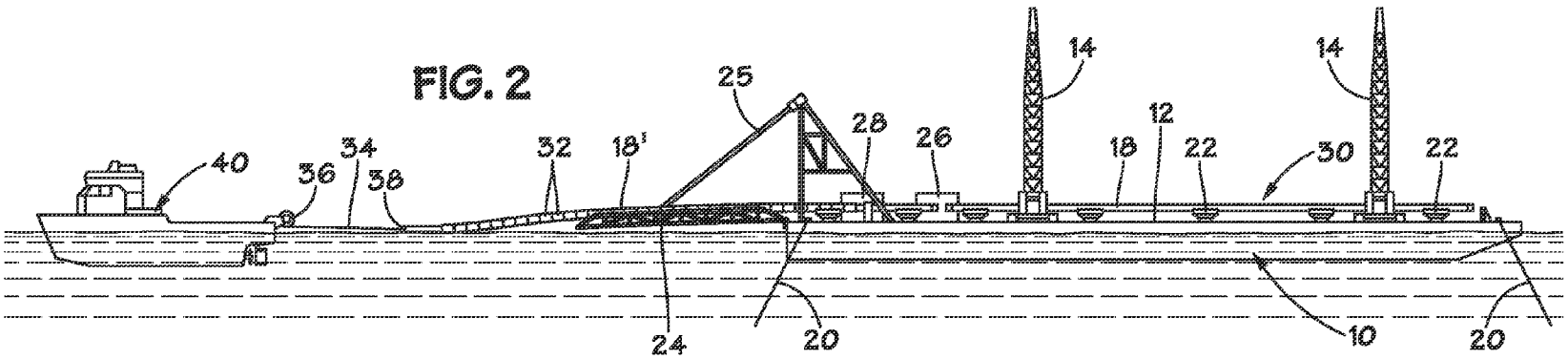
FIG. 2

METHOD FOR ASSEMBLING TENDONS

CROSS-REFERENCE TO RELATED APPLICATIONS

This application is a continuation of U.S. patent application Ser. No. 13/095,597 filed on Apr. 27, 2011, which claims the benefit of U.S. Provisional Application No. 61/328,297, filed on Apr. 27, 2010.

STATEMENT REGARDING FEDERALLY SPONSORED RESEARCH OR DEVELOPMENT

Not Applicable

BACKGROUND OF THE INVENTION

1. Field of the Invention

This invention relates to offshore platforms. More particularly, it relates to a method for assembling the tendons used to moor a tension leg platform.

2. Description of the Related Art Including Information Disclosed Under 37 CFR 1.97 and 1.98.

A tension leg platform (TLP) is ideal for developing deepwater reserves. No other floating production facility design offers the optimal motion and stability characteristics of a tension leg platform. The TLP is vertically moored using tubular steel tendons and is supported by a buoyant hull. The tendon stiffness results in a system with virtually no heave, roll or pitch. This makes the TLP suitable for both dry tree and sub-sea completions.

A number of TLP solutions for deepwater field development have been designed, built and deployed around the world. The designs include both mono-column TLPs and multi-column TLPs.

The key benefits of a TLP are:

- Minimum motion characteristics provide optimum support for risers and drilling/production equipment, and maximize personnel comfort and safety.
- Vertical tendons provide small deepwater mooring profile and footprint thus allowing easy access around the platform for spread-moored drilling vessels and riser/umbilical installation vessels.
- Scalable hull designs accommodate different payload requirements keeping design and engineering costs low for superior cost efficiency.
- Modular, stiffened-plate hulls can be built in most shipyards or marine fabrication yards.

All currently deployed TLPs have had their tendon systems installed by one of the following known methods:

Vertical stalking. Tendons are assembled offshore vertically at the surface by connecting joints of pipe vertically and lowering the assembly as additional joints are added to the string. The length of the joints is governed by the ability to handle and lift using a tall crane, and the availability of a tall assembly tower. Smaller facilities can be substituted when shorter joints are used, but assemblies of shorter joints require more time and more joints, and the cost of the couplings is increased.

One-piece wet tow. In this method, tendons are assembled by welding at a remote location (usually onshore) and subsequently towed in a horizontal orientation to the installation site. Tendons may be buoyant, neutrally buoyant or supported by floats to keep them at the surface. The top and bottom fittings are typically neither buoyant nor neutrally buoyant, and therefore require that floats be attached at each end of the tendon to provide support during the tow. Upon reaching the installation site, the tendon is upended by releasing selected floats while supporting the upper end from either the TLP or a support vessel.

Once the tendon is in the water and vertically oriented, the tendon can be either pre-installed by connecting its lower end to an existing anchor system and supporting its upper end with a temporary float, or co-installed by passing it over to the TLP to hang from the TLP vessel.

BRIEF SUMMARY OF THE INVENTION

The present invention is a new method of assembling tendons offshore in a horizontal orientation using relatively low cost facilities.

A tendon is assembled at or near the installation site in a horizontal orientation using connectors or weld stations on a barge or other vessel. During assembly, the tendon is pulled away from the assembly vessel and tensioned by a tug or offshore work vessel. When fully assembled, the tendon is up-ended (in a manner similar to a wet-towed tendon) and then either preinstalled using floats or passed over to the TLP which is on-site and ready to receive the tendons.

The method of the invention can reduce both the fabrication and installation costs of TLP tendon system.

BRIEF DESCRIPTION OF THE SEVERAL VIEWS OF THE DRAWING(S)

FIG. 1 is a top plan view of a tendon being assembled on a tendon assembly vessel while the tendon is tensioned by a tug according to the method of the invention.

FIG. 1A is an enlargement of the portion indicated in FIG. 1.

FIG. 2 is a side view of the tendon assembly apparatus illustrated in FIG. 1.

DETAILED DESCRIPTION OF THE INVENTION

The costs of fabricating a tendon system and the installation of a tendon system are both related to the length of the individual pipe joints and the cost of the offshore support vessels needed to handle them.

The one piece wet tow system requires a large on-shore facility to handle the long tendons as they are assembled, but requires a minimum offshore spread to up-end the tendons.

There are also the costs associated with the risk of a long tow (in both known examples of this type of installation, one or more tendons have been dropped during the tow). This configuration does not require any couplings, which can result in large cost savings.

Vertical stalking requires a vessel with the ability to handle joints of finished tendon pipe and a tower to hold the joint correctly aligned while the connection is made. For typical tendon joint lengths of 250 to 300 ft., a large offshore crane vessel is used which is a very expensive offshore spread.

Reducing the length of joints to 120 to 150 ft. allows a smaller crane and smaller tower to be used (lower day rate), but increases the assembly time and also increases the number of joints, thereby increasing cost in both of these areas.

The method of the present invention permits use a much lower cost barge (e.g., a pipe-lay barge) to assemble the tendon horizontally using long joints with either connectors or offshore welding. The offshore spread costs can be reduced from a large crane vessel, the assembly time is relatively short owing to the use of long joints, and the risks associated with a wet tow are eliminated.

In the method of the present invention, a tendon is assembled at or near the installation site in a horizontal orientation using connectors or weld stations on a barge or other similar vessel. During assembly, the tendon is pulled away from the assembly vessel as its length progresses and tensioned by a tug or offshore work vessel. When fully assembled, the tendon may be up-ended in a manner similar to a wet-towed tendon, and then either preinstalled using floats or passed over to the TLP which is on-site and ready to receive the tendons.

Referring now to FIGS. 1 and 2, tendon assembly vessel 10 may have a barge-type hull and may be secured at a desired location using anchor lines 20. Alternatively, a dynamic positioning system (not shown) may be used for stationkeeping.

Assembly vessel 10 may have one or more cranes 14 on deck 12 for lifting and transferring tendon segments 18 from supply vessel 16 (shown moored alongside vessel 10) to tendon supports 22 on deck 12. Tendon supports 22 are generally aligned with welding station 26, inspection station 28 and stinger 24. Stinger 24 may be supported by gantry 25 and may project from the aft end of vessel 10. Gantry 25 may be used to adjust the angle of stinger 24 relative to deck 12 (or the plane of supports 22). As will be appreciated by those skilled in the art, the horizontal plane of supports 22 is above the water line of vessel 10. Accordingly, that portion of tendon assembly 30 which is floating at or near the water surface Will be at a different elevation than that portion which is supported on supports 22 on deck 12 of vessel 10. Stinger 24 may be used to minimize the bend radius of tendon 30 as it transitions from assembly vessel 10 into its horizontal floating position in the water.

Also shown in FIGS. 1 and 2 is tug 40 equipped with winch 36 which may be a constant-tension winch. Tensioning line 34 is attached to winch 36 and first end 38 of tendon 30, Tendon tensioning vessel 40 need not be a tugboat, per se, but rather any suitable vessel capable of tensioning tendon 30 via line 34 such that tendon 30 remains substantially aligned with tendon supports 22 on vessel 10 during the assembly of tendon segments 18. Clamping means (shown as part of station 28) transfers the tension load in tendon segment 18' to vessel 10. In certain embodiments, the propulsion system of tensioning vessel 40 and/or winch 36 may form a part of a dynamic positioning system for vessel 10.

As may best be seen in FIG. 1A, one or more floatation jackets 32 may be installed on selected segment(s) 18' of tendon 30 during tendon assembly to ensure the desired buoyancy while the tendon undergoing assembly is floating in the sea in a generally horizontal orientation.

Tendons may be assembled from tendon segments 18 by any suitable method, Most commonly, tendon segments 18 will be joined together by welding at station 26 and then pass to weld inspection station 28 for quality control purposes. Alternatively, tendon connectors may be installed at station 26 and damped at station 28. In certain embodiments, floatation devices 32 may be installed at station 28 and/or 26.

Although the invention has been described in detail with reference to certain preferred embodiments, variations and modifications exist within the scope and spirit of the invention as described and defined in the following claims.

What is claimed is:

1. A method for assembling a tendon for a tension leg platform comprising:

joining tendon segments together in a horizontal orientation on a first floating vessel to produce a tendon assembly;

floating a first portion of the tendon assembly horizontally on the surface of the sea; and, simultaneously applying a sufficient tension load to the tendon assembly with a second vessel connected to the first portion of the tendon assembly at a point that is remote from the first vessel such that the tendon assembly lies in a substantially horizontal line between the first vessel and the second vessel.

2. The method as recited in claim 1 wherein the first end of the tendon assembly is floating in the sea.

3. The method as recited in claim 2 wherein the first end of the tendon assembly has one or more floatation devices attached thereto.

4. The method as recited in claim 1 wherein the tension load is applied to the first portion of the tendon assembly using a winch mounted on the second vessel and a winch cable attached to the first end of the tendon assembly.

5. The method as recited in claim 4 wherein the winch is a constant-tension winch.

6. The method as recited in claim 1 wherein the first vessel comprises a stinger configured to progressively lower the tendon assembly from the deck of the first vessel to the water surface.

7. The method as recited in claim 1 wherein the first vessel comprises a plurality of deck-mounted tendon segment supports.

8. The method as recited in claim 1 wherein the first vessel comprises a tendon segment welding station.

9. The method as recited in claim 8 wherein the first vessel comprises a plurality of deck-mounted tendon segment supports aligned with the tendon segment welding station.

10. The method as recited in claim 1 wherein the first vessel comprises means for securing the tendon assembly to the first vessel to accommodate a tensile load applied to the tendon assembly.

11. The method as recited in claim 1 wherein the first vessel comprises a clamping station on the first vessel configured for installing a clamp on a tendon connector.

12. The method as recited in claim 1 wherein the first vessel comprises a weld inspection station.

13. A method for installing a tendon for a tension leg platform comprising:

joining tendon segments together in a horizontal orientation on a first floating vessel to produce a tendon assembly;

floating a first portion of the tendon assembly horizontally on the surface of the sea;

simultaneously applying a sufficient tension load to the tendon assembly during assembly with a second vessel connected to the first portion of the tendon assembly at a point that is remote from the first vessel such that the tendon assembly lies in a substantially horizontal line between the first vessel and the second vessel;

upending the completed tendon assembly in the sea such that the tendon is substantially vertical; and, lowering the tendon into a bottom tendon connector preinstalled on the seafloor.

14. A method for installing a tendon for a tension leg platform comprising:

joining tendon segments together in a horizontal orientation on a first floating vessel to produce a tendon assembly;

floating a first portion of the tendon assembly horizontally on the surface of the sea;

simultaneously applying a sufficient tension load to the tendon assembly during assembly with a second vessel connected to the first portion of the tendon assembly that is remote from the first vessel such that the tendon assembly lies in a substantially horizontal line between the first vessel and the second vessel;

upending the completed tendon assembly in the sea such that the tendon is substantially vertical; and, passing the upended tendon to a tension leg platform.

* * * * *